United States Patent [19]

McNab

[11] Patent Number: 5,019,793

[45] Date of Patent: May 28, 1991

[54] DIGITALLY IMPLEMENTED VARIABLE PHASE SHIFTER AND AMPLITUDE WEIGHTING DEVICE

[75] Inventor: Kevin M. McNab, Hawthorne, Calif.

[73] Assignee: Hughes Aircraft Company, Los Angeles, Calif.

[21] Appl. No.: 526,160

[22] Filed: May 21, 1990

[51] Int. Cl.[5] ..... H01P 1/18

[52] U.S. Cl. ..... 333/156; 333/139

[58] Field of Search ..... 333/117, 138–140, 333/156, 164; 342/371, 372, 375, 377; 343/777, 778

[56] References Cited

U.S. PATENT DOCUMENTS

| | | | |
|---|---|---|---|
| 3,882,431 | 5/1975 | Hopwood et al. | 333/139 |
| 4,153,886 | 5/1979 | Miedema | 333/156 |
| 4,166,274 | 8/1979 | Reudink et al. | 342/377 X |
| 4,232,399 | 11/1980 | Heiter | 333/164 X |
| 4,398,161 | 8/1983 | Lamb et al. | 333/156 |
| 4,581,595 | 4/1986 | Silagi | 333/139 |
| 4,616,231 | 10/1986 | Autrey et al. | 342/371 X |
| 4,901,265 | 2/1990 | Kerr et al. | 328/14 X |

*Primary Examiner*—Eugene R. Laroche
*Assistant Examiner*—Seung Ham
*Attorney, Agent, or Firm*—Robert A. Westerlund; Steven M. Mitchell; Wanda K. Denson-Low

[57] ABSTRACT

A variable phase shifter and amplitude weighting (VPSAW) device capable of selectively varying the phase and amplitude of an incoming RF signal ($RF_{IN}$) in such a manner as to produce an output RF signal ($RF_{OUT}$) having a selected phase and amplitude, by means of splitting the $RF_{IN}$ signal into first and second signal components, selectively shifting the phase of each of these two components, and then combining the thusly selectively phase-shifted first and second signal components. In the presently contemplated best mode of the present invention, the VPSAW device includes digitally-implemented componentry, e.g., microprocessor-controlled direct, digital synthesizers, for generating first and second control signals, e.g., selectively phase-shifted sinusoidal signals, indicative of first and second phase shift increments, $\phi_a$ and $\phi_b$, respectively, to be imparted to the first and second signal components, respectively. The VPSAW device of the best mode further includes first and second signal mixers for mixing together the first and second control signals with the corresponding first and second signal components, to thereby phase shift the first and second signal components by the first and second phase increments $\phi_a$ and $\phi_b$, respectively. The first and second phase shift increments, $\phi_a$ and $\phi_b$, satisfy a prescribed algorithm which results in the $RF_{OUT}$ signal having the selected phase ($\phi_c$) and the selected amplitude (C), e.g., $\phi_a=\phi_c+\cos^{-1}(\frac{1}{2}C)$ and $\phi_b=\phi_c-\cos^{-1}(\frac{1}{2}C)$. Additionally, the first and second mixers may serve to downconvert the $RF_{IN}$ signal by subtracting the frequency of the first and second control signals from the frequency of the first and second signal components.

15 Claims, 3 Drawing Sheets

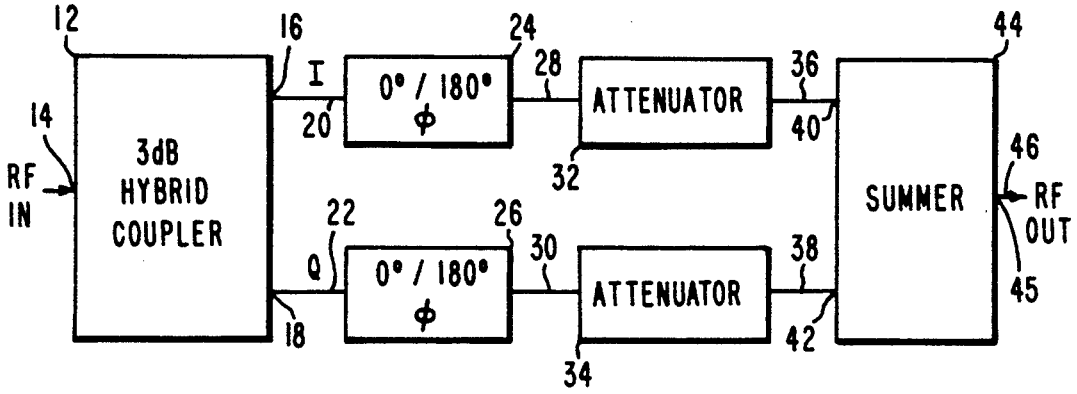
Fig. 1.
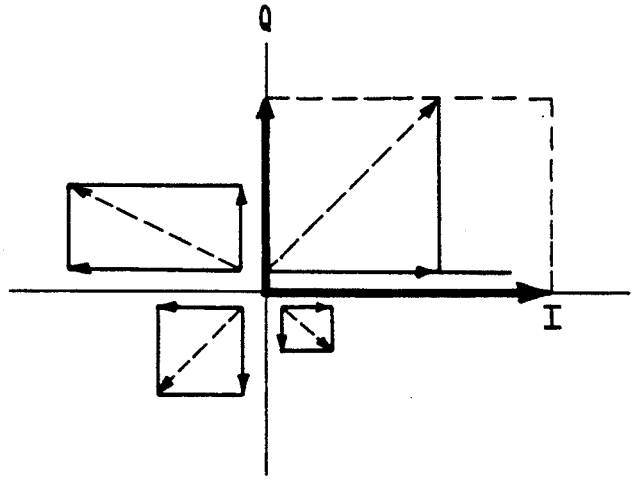
Fig. 2.
Fig. 3.
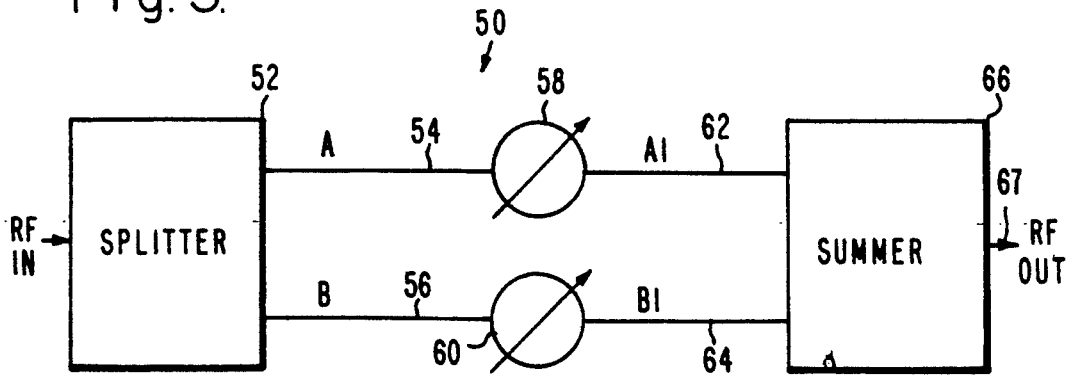

DIGITALLY IMPLEMENTED VARIABLE PHASE SHIFTER AND AMPLITUDE WEIGHTING DEVICE

FIELD OF THE INVENTION

This invention relates generally to devices for controllably varying the phase and amplitude of an electrical signal applied thereto, and more particularly, to a novel variable phase and amplitude weighting circuit which utilizes a direct, digital synthesizer to controllably vary the phase and amplitude of an incoming electrical signal, e.g., an RF-signal. It is presently contemplated that the present invention may have particular utility in beam forming and steering networks and/or adaptive nulling processors employed in radar and satellite communications systems.

BACKGROUND OF THE INVENTION

The prior art is replete with various types of devices for controllably varying the phase and amplitude of an electrical signal applied thereto. These variable phase shifter/amplitude weighting devices are utilized in a wide variety of applications, e.g., in beam forming and steering networks (BFSN's) for phased array antennas such as are employed in radar and satellite communications systems.

Phased array antennas are generally comprised of a multiplicity of individual radiating or antenna elements which are geometrically configured in accordance with the desired coverage and beam characteristics of the particular phased array antenna under consideration. For example, the antenna elements may be arranged in a one-dimensional linear array, a two-dimensional planar array, or a three-dimensional circular array. The array of individual antenna elements cooperate in a well-known manner, e.g., in a transmit mode of operation, to produce a focussed beam of electromagnetic radiation (e.g., a microwave RF-signal) having a desired far field pattern pointed in a desired direction, to thereby provide a desired beam coverage area. More particularly, each of the antenna elements is fed with RF power at controlled relative phases and amplitudes to form the focussed beam having the desired shape and pointing direction. The required phase and power/amplitude distributions have been implemented by various forms and combinations of beam forming and steering networks incorporating variable phase shifter and power dividing (amplitude weighting) devices which controllably couple a common source of RF power to the individual antenna elements of the phased array antenna. The resultant beam produced by this excitation of the antenna elements may be electronically steered to any desired beam scan angle within a 360° azimuth coverage area, e.g., under the control of a phase selecting or switching matrix, such as a Butler matrix. The precision, accuracy, and reliability of these beam forming and steering networks are largely dependent upon these characteristics of the variable phase shifter and amplitude weighting components employed therein. These characteristics of the present state-of-the-art phase shifter and amplitude weighting devices are unduly constrained.

More particularly, the current state-of-the-art phase shifter and power dividing devices are implemented as I/Q weighting circuitry, wherein an incoming RF-signal is split into I and Q components which are in phase quadrature with each other, with each signal component being independently phase shifted by either 0° or 180° and thence, independently attenuated (i.e., amplitude weighted). Full four-quadrant variable phase and amplitude control over the incoming RF-signal is achieved by adjusting the setting of the attenuators and switching the phases (between 0° and 180°) of the signal components I and Q.

One major shortcoming of these current state-of-the-art variable phase shifter and power dividing devices is that they are limited in resolution, at best, to approximately 2° phase shift increments, depending on the attenuation limits. Another major shortcoming of these state-of-the-art variable phase shifter and power dividing devices is that they are inherently inaccurate and unreliable. More particularly, these devices utilize analog components, such as attenuators, which exhibit drift, over time and temperature. The analog attenuators, in particular, exhibit variations and non-linearities in their intercept point and amplitude flatness at different attenuation settings over the operating frequency band. Further, these devices are somewhat bandwidth-limited in that they are inaccurate over broad bandwidths.

Based on the above and foregoing, it can be appreciated that there presently exists a need for a variable phase shifter and amplitude weighting device which overcomes, or at least minimizes, the above-delineated shortcomings associated with the presently available variable phase shifter and amplitude weighting devices.

The present invention fulfills this need, in a manner which will become apparent from the ensuing brief and detailed descriptions thereof.

SUMMARY OF THE INVENTION

The present invention encompasses a variable phase shifter and amplitude weighting (VPSAW) device capable of selectively varying the phase and amplitude of an incoming RF signal ($RF_{IN}$) in such a manner as to produce an output RF signal ($RF_{OUT}$) having a selected phase and amplitude, by means of splitting the $RF_{IN}$ signal into first and second signal components, selectively shifting the phase of each of these components, and then combining the thusly selectively phase-shifted first and second signal components. The VPSAW device of the presently preferred embodiment of the instant invention is essentially digitally implemented.

More particularly, the VPSAW device of this invention preferably includes digitally-implemented componentry for generating first and second control signals indicative of first and second phase shift increments, $\phi_a$ and $\phi_b$, respectively, to be imparted to the first and second signal components, respectively, and facilities responsive to the first and second control signals for phase shifting the first and second signal components by the phase shift increments $\phi_a$ and $\phi_b$, respectively. The first and second phase shift increments satisfy a prescribed algorithm which results in the $RF_{OUT}$ signal having the selected phase ($\phi_c$) and the selected amplitude (C), e.g., $\phi_a=\phi_c+\cos^{-1}(\frac{1}{2}C)$ and $\phi_b=\phi_c-\cos^{-1}(\frac{1}{2}C)$. The first and second control signals suitably comprise first and second sinusoidal signals phase-shifted by the first and second phase shift increments $\phi_a$ and $\phi_b$, respectively.

In the presently contemplated best mode of the instant invention, these first and second control signals are generated by first and second direct, digital synthesizers whose outputs are phase shifted in the above-described manner by first and second digital means operatively associated therewith, in response to first and second phase shift command signals representative of the first and second phase shift increments $\phi_a$ and $\phi_b$, respectively. The first and second phase shift command signals may be generated by a digital device (e.g., a microprocessor) which is programmed to implement the above-described prescribed algorithm.

The facilities responsive to the first and second control signals preferably comprise a first mixer for mixing together the first signal component and the first control signal, and a second mixer for mixing together the second signal component and the second control signal. The first and second mixers function to superimpose the first and second phase shift increments $\phi_a$ and $\phi_b$ onto the first and second signal components, respectively. Additionally, the first and second mixers may serve to downconvert (or upconvert) the $RF_{IN}$ signal by subtracting (adding) the frequency of the first and second control signals from (to) the frequency of the first and second signal components.

Many other features, aspects, and advantages of the present invention will become apparent from the following detailed description of the invention taken in conjunction with the accompanying drawings, in which:

BRIEF DESCRIPTION OF THE DRAWINGS

FIG. 1 is a block diagram of a typical prior art I/Q weighting circuit.

FIG. 2 is a phasor diagram for the prior art I/Q weighting circuit depicted in FIG. 1.

FIG. 3 is a generic block diagram of a variable phase shifter and amplitude weighting device embodying the fundamental principles of the present invention.

DETAILED DESCRIPTION OF THE INVENTION

Figure 4A:
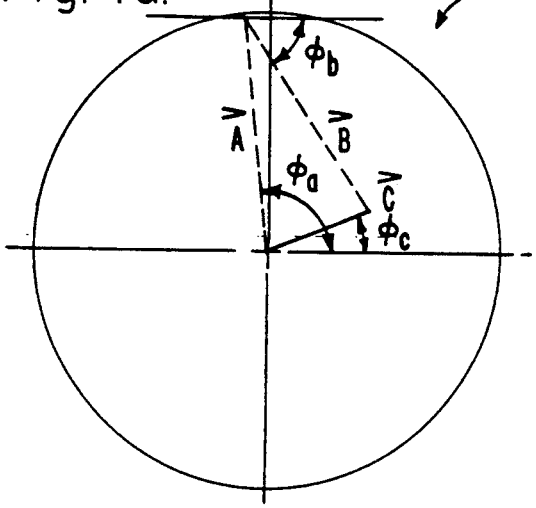
FIGS. 4*a* and 4*b* are phasor diagrams which illustrate the mathematical basis of the present invention.

Referring now to FIG. 1, there can be seen a block diagram of a typical, state-of-the-art variable phase shifter and amplitude weighting circuit 10, which will hereinafter be referred to as "the prior art I/Q weighting circuit." As can be seen in FIG. 1, the prior art I/Q weighting circuit 10 includes a directional or hybrid coupler 12 which functions to equally divide an incoming RF signal, $RF_{IN}$, applied to its input port 14, into two components, I and Q. The I and Q components are outputted through respective output ports 16, 18 of the coupler 12, over respective transmission lines 20, 22. The terminology "transmission lines" as used hereinthroughout is intended to encompass any convenient type of electromagnetic signal-carrying device, such as conductors, travelling wave tubes/waveguides, microwave transmission strip lines, coaxial lines, microstrip lines, or the like. As is well-known, the two RF signal components I and Q are in phase quadrature with each other, with the I component being in-phase with the incoming RF signal and the Q component being ±90° out-of-phase with the incoming RF signal, i.e., the Q signal component leads or lags the I signal component by 90°. The I and Q signal components are applied to respective 0°/180° phase selectors or shifters 24, 26, which may conveniently be embodied as double-balanced mixers, or the like. The 0°/180° phase shifters 24, 26 can be thought of as components which are selectively controllable or switchable to either invert or pass unaltered a signal applied thereto. Thus, with the prior art I/Q weighing circuit 10, the signal components I and Q can be independently phase shifted by 0° or 180°. After the signal components I and Q have been independently, selectively phase shifted by either 0° or 180°, they are applied over transmission lines 28, 30, respectively, to respective attenuators 32, 34. The value or setting of the attenuators 32, 34 can be selectively varied to thereby selectively attenuate or vary the amplitude of each of the signal components I and Q, independently.

Thus, as is depicted in the phasor diagram of FIG. 2, the phase shifters 24, 26 and the attenuators 32, 34 cooperatively function in such a manner as to facilitate full four (4)-quadrant amplitude and phase control over the signal components I and Q. Accordingly, after the signal components I and Q have been selectively phase shifted and selectively attenuated, they are applied over transmission lines 36, 38, respectively, to respective input ports 40, 42 of power summer 44, which functions in a well-known manner to combine or sum together the signal components I and Q and output the combined signal through its output port 45 over output transmission line 46. The combined output signal, designated as $RF_{OUT}$, constitutes a selectively phase shifted and amplitude weighted version of the $RF_{IN}$ signal. If, for example, this circuit 10 were employed in a beam-forming network (not shown) of a phased array antenna system (not shown), the $RF_{OUT}$ signal would be in a form suitable for application to an individual antenna or radiating element (not shown) of the phased array antenna system, e.g., via a suitable amplifier (such as a solid-state power amplifier not shown), to thereby excite the individual radiating element in order to, in turn, produce a beam having a desired shape and pointing direction.

As was discussed in some depth hereinbefore, the prior art I/Q weighting circuit 10 described above suffers from various drawbacks and shortcomings which limit its utility in certain applications, e.g., in active phase array or multi-beam antenna systems which require high-resolution, accurate, and reliable (e.g., over a 10 year satellite service life) adaptive and/or commandable beam forming and/or steering capabilities, in order to achieve precision beam agility, high gain, and high rejection of interference. The various drawbacks and shortcomings of the prior art I/Q weighting circuit 10 are primarily attributable to the fact that the analog attenuators 32, 34 are inherently inaccurate and unreliable to an unacceptable degree for at least some applications, such as those applications mentioned above, e.g., due to frequency roll-off, IP (intercept point) degradation, and phase shift variations with varying attenuation levels. Further, the analog attenuators 32, 34 and the analog phase shifters 24, 26 have operating/attenuation limits which reduce the overall resolution of the circuit 10. Further, the circuit 10 is bandwidth-limited by virtue of the analog attenuators 32, 34 exhibiting non-linearities over typical signal bandwidth. In any event, the present invention, which will now be described, eliminates or at least substantially minimizes these drawbacks and shortcomings of the prior art I/Q weighting circuit 10 by provision of a variable phase shifter and amplitude weighting device which is essentially digitally implemented.

More particularly, with reference now to FIG. 3, there can be seen a generic block diagram of a variable phase shifter and amplitude weighting (VPSAW) device 50 embodying the fundamental principles of design and operation of the present invention. In general, the VPSAW device 50 of the present invention includes a splitter 52 which splits an incoming RF signal, $RF_{IN}$, into signal components A and B. Although not presently considered limiting to the invention, the splitter 52 is preferably embodied as an equal power divider which results in the signal components A and B being of equal amplitude. However, as will be developed hereinbelow, the signal components A and B may suitably be either in-phase (which is more convenient from a hardware implementation standpoint), or out-of-phase by any predetermined amount, e.g., ±90°. In any event, the RF signal components A and B are applied over transmission lines 54, 56, respectively, to respective selectively variable phase shifters 58, 60, which are selectively controllable to independently adjust or shift the phase of the signal components A and B. Preferably, although not limiting to the broader inventive aspects of the present invention, the variable phase shifters 58, 60 are capable of selectively varying the phase of the signal components A and B by fine increments or steps (e.g., less than 1° increments), over a full, four-quadrant range (i.e., 360° range). Most preferably, as will be fully developed hereinafter, the variable phase shifters 58, 60 are digitally implemented. In any event, the thusly variable phase-shifted signal components A1 and B1 are applied over transmission lines 62, 64, respectively, to a power summer 66, which functions in a conventional manner to sum together or combine the phase-shifted signal components A1 and B1, and to output the thusly combined signal, $RF_{OUT}$, over output line 67. As will become clear from the following discussion, by independently and selectively adjusting or shifting the phase of each signal component A and B, the phase and amplitude of the $RF_{OUT}$ signal can be selectively varied. It can thus be appreciated that the broadest aspect of the present invention resides in the provision of a variable phase shifter and amplitude weighting device which operates to selectively vary both the phase and amplitude of an RF signal applied thereto, in a very reliable manner and with very high resolution, by means of only adjusting the phase of the RF signal components A and B, thereby eliminating the need for the particularly disadvantageous attenuators required by prior art devices.

Figure 4B:
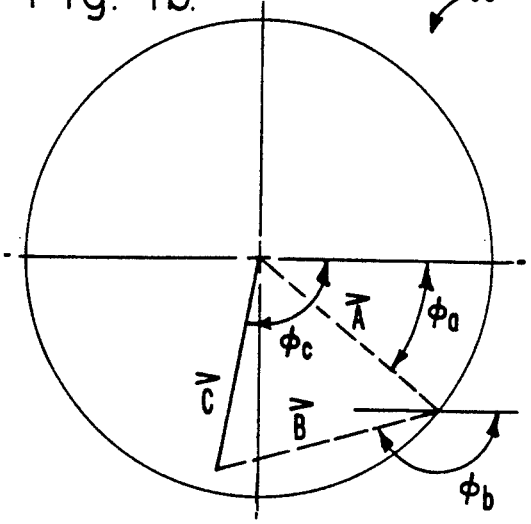

The discussion will now proceed to an explanation of the mathematical basis for the above-described operation of the generic variable phase shifter and amplitude weighting device 50 which embodies the broadest aspect of the present invention. More particularly, with particular reference now to FIGS. 4*a* and 4*b*, it is shown geometrically that any point in the unit circle 68 can be realized as the sum $\overline{C}$ of two equal amplitude phasors $\overline{A}$ and $\overline{B}$, whose phases are independently adjustable/variable. In this regard, it will be appreciated that the phasor components $\overline{A}$ and $\overline{B}$ of $\overline{C}$ are mathematical representations of the RF signal components A and B, and further, that the sum phasor $\overline{C}$ is a mathematical representation of the $RF_{OUT}$ signal which is the sum of the signal components A and B. For purposes of the ensuing analysis, it is assumed that the sum phasor $\overline{C}=Ce^{\phi c}$ represents an $RF_{OUT}$ signal which has the desired amplitude and phase shift, i.e., the $RF_{OUT}$ signal is a version of the $RF_{in}$ signal which is selectively phase shifted and amplitude weighted by the desired amounts; where C represents the desired amplitude and $\phi_c$ represents the desired phase of the $RF_{OUT}$ signal. Likewise, $\overline{A}=Ae^{j\phi a}$ and $\overline{B}=Ae^{j\phi b}$ phasor components of $\overline{C}$ which have equal amplitudes, A. In fact, without loss of generality $\overline{A}$ and $\overline{B}$ can be unit vectors, whereby:

$$A=e^{j\phi a};$$

$$B=e^{j\phi b};$$

and, $$C=Ce^{j\phi c}=A+B=e^{j\phi a}+e^{j\phi b}.$$

Figure 5A:
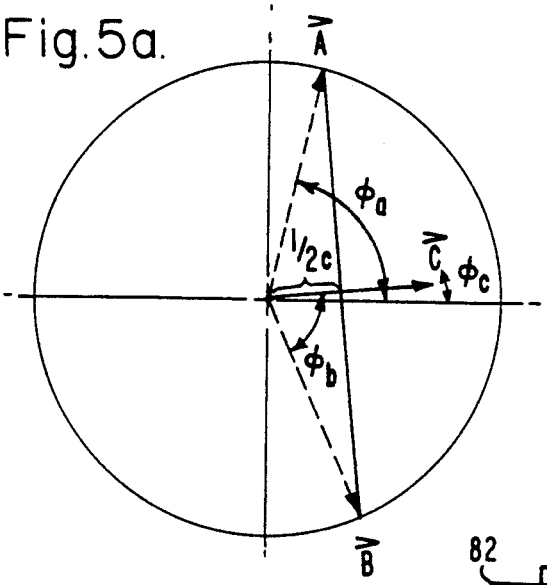
FIGS. 5*a* and 5*b* are phasor diagrams which further illustrate the mathematical basis of the present invention.

By analytically determining $\phi_a$ and $\phi_b$ in terms of C and $\phi_c$ it is possible to generate an algorithm for determining $\phi_a$, $\phi_b$ for any desired C, $\phi_c$. More particularly, with reference now to FIGS. 5*a* and 5*b*, this analytical determination can be made by finding $\overline{A}$ and $\overline{B}$ such that the projection of $\overline{A}$ and $\overline{B}$ onto $\overline{C}$ are equal (i.e., equal C/2), and the perpendicular components of $\overline{A}$ and $\overline{B}$ relative to $\overline{C}$ are equal and opposite, i.e., $$A\cdot C=\tfrac{1}{2}C$$

$$B\cdot C=\tfrac{1}{2}C,$$

and $$A\sin\phi_{ac}=-B\sin\phi_{bc}.$$

Since $A=B$, then $$\sin\phi_{ac}=-\sin\phi_{bc},$$

and ergo, $\phi_{ac}=-\phi_{bc}$, where $\phi_{bc}$=angle between B,C, and $\phi_{ac}$=angle between A,C.

Figure 5B:
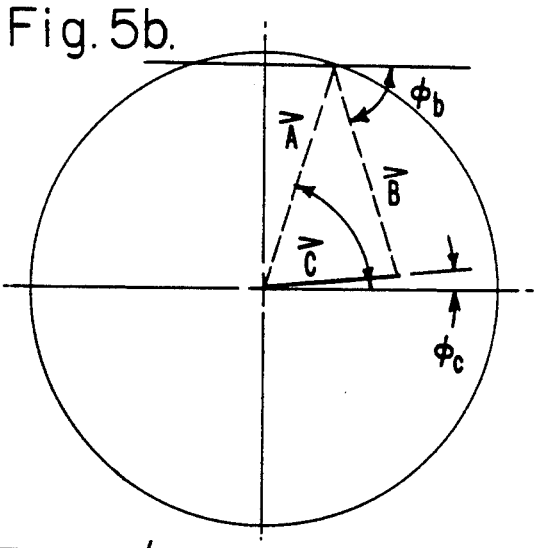

The above equations imply that the desired conditions can be met if $\overline{A}$, $\overline{B}$, and $\overline{C}$ form an isosceles triangle as shown in FIG. 5*b*, which straightforwardly leads to the following equations:

$$\phi_a=\phi_c+\cos^{-1}(\tfrac{1}{2}C), \quad (1)$$

and $$\phi_b=2\phi_c-\phi_a=\phi_c-\cos^{-1}(\tfrac{1}{2}C), \quad (2)$$

where $\phi_a$, $\phi_b$ are measured with respect to the positive abscissa.

From the above equations (1) and (2), it can be seen that for any desired amplitude (C) and phase ($\phi_c$) of the $RF_{OUT}$ signal, the corresponding values for $\phi_a$ (i.e., the phase of signal component A) and $\phi_b$ (i.e., the phase of signal component (B) can be readily determined. Thus, it can now be appreciated that the VPSAW device 50 of the present invention is operable to selectively vary the phase and amplitude of an incoming RF signal ($RF_{IN}$) to produce an output RF signal ($RF_{OUT}$) having any desired amplitude (C) and phase angle ($\phi_c$), by means of only adjusting the phase angle ($\phi_a$, $\phi_b$) of the RF signal components A and B. As will be appreciated by those skilled in the art, the above equations (1) and (2) may be implemented by utilizing a microprocessor, read-only memory (ROM) [for storing a specific set of $\phi_a$, $\phi_b$ values for a prescribed set of desired C, $\phi_c$ values], or any other convenient facilities for either real-time computation of values of or storage of pre-computed values of $\phi_a$, $\phi_b$. The ensuing portion of this discussion is directed to a description of the presently contemplated best mode of carrying out the aforedescribed principles of the present invention, including a preferred embodiment of essentially digitally implemented variable phase shifters which are responsive to digital command signals representative of the $\phi_a$, $\phi_b$, values which are required in order to achieve desired C, $\phi_c$ values, for imparting the requisite phase shift increments $\phi_a$, $\phi_b$ to the RF signal components A and B.

Figure 6:
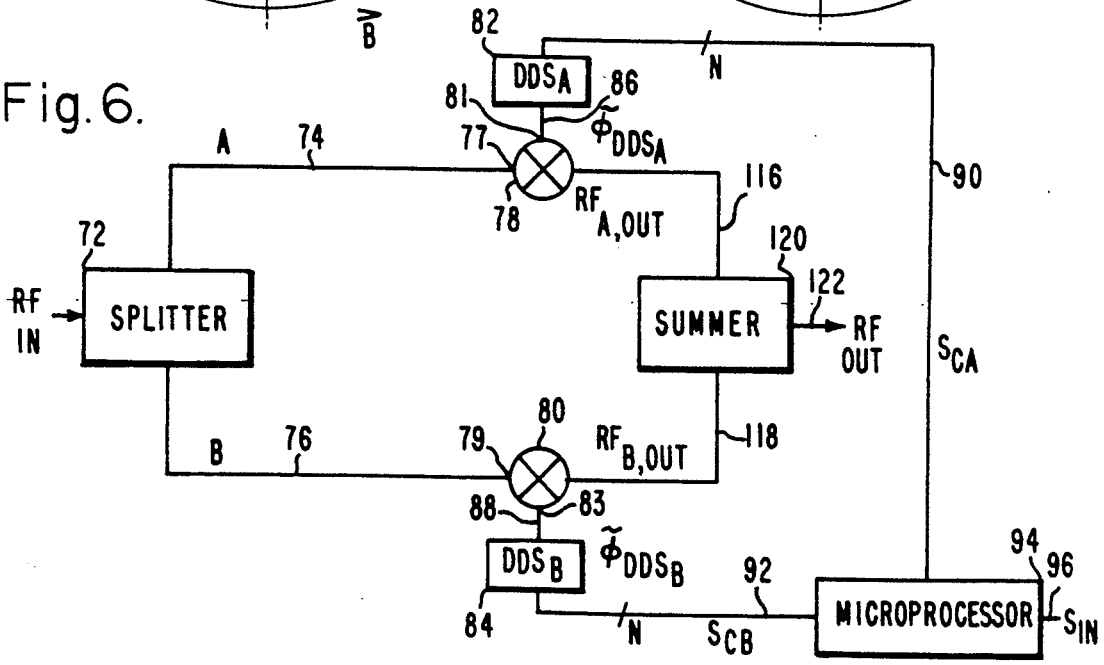
FIG. 6 is a block diagram depicting a variable phase shifter and amplitude weighting device embodying the presently contemplated best mode of the instant invention.

Referring now to FIG. 6, there can be seen a block diagram of the presently contemplated best mode of a VPSAW device 70 embodying the above-described features of the present invention. The VPSAW device 70 includes a signal splitter 72 which splits an incoming RF signal, $RF_{IN}$, into signal components A and B, which are applied over transmission lines 74, 76, respectively, to first inputs 77, 79 of respective signal mixers 78, 80. The VPSAW device 70 further includes direct, digital synthesizers ($DDS_A$ and $DDS_B$) 82, 84 whose outputs, $\phi_{DDS,a}$ and $\phi_{DDS,b}$, are couple over transmission lines 86, 88, respectively, to second inputs 81, 83 of the signal mixers 78, 80. The DDS's 82, 84 are configured to receive N-bit command signals, $S_{CA}$ and $S_{CB}$, over N parallel lines, represented schematically as singular lines 90, 92. The command signals $S_{CA}$ and $S_{CB}$ are issued by a microprocessor 94, or alternatively, a ROM device (not shown). The microprocessor 94 is programmed to implement the equations (1) and (2) discussed previously, so that the digital command signals $S_{CA}$ and $S_{CB}$ issued thereby are representative of the $\phi_a$, $\phi_b$ values which are required in order to achieve the desired C, $\phi_c$ values. In order to enable the microprocessor 94 to perform the necessary calculations for determining the $\phi_a$, $\phi_b$ values, the microprocessor 94 receives, via an input line 96, a digital input signal $S_{IN}$ representative of the desired C, $\phi_c$ values.

Figure 7:
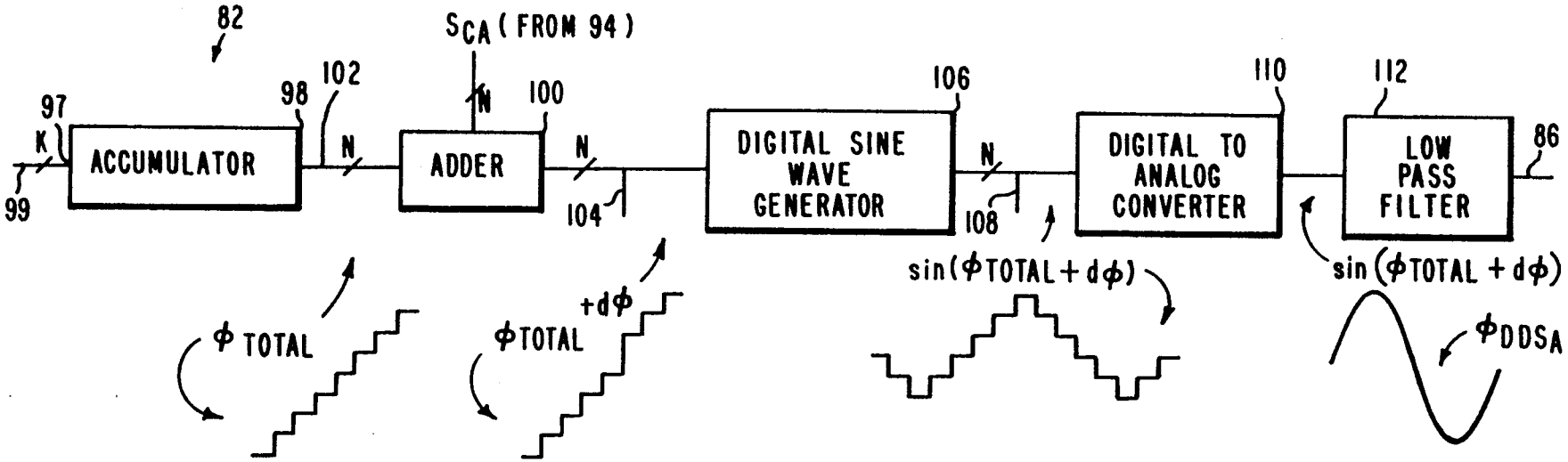
FIG. 7 is a functional block diagram illustrating the operation of a direct, digital synthesizer as adapted for use in the device depicted in FIG. 6.

In operation, the VPSAW device 70 works in the following manner. Generally speaking, the DDS's 82, 84 function as very accurate, high resolution, digital phase shifters, in that their output signals, $\phi_{DDS,a}$ and $\phi_{DDS,b}$, are sine waves which can have their phase shifted by extremely fine phase shift steps/increments in response to the digital command signals $S_{CA}$ and $S_{CB}$ issued by the microprocessor 94. More particularly, with additional reference now to FIG. 7, there can be seen a diagrammatical depiction of the DDS 82, it being understood that the DDS 84 is of identical construction. In FIG. 7, the DDS 82 is shown to include an accumulator 98 which has a number K (e.g., 28) of input ports 97 which are adapted to receive a like number (i.e., K) of digital bits clocked thereinto over lines 99 by a clocking device (not shown), e.g., by a crystal oscillator, at a predetermined clock frequency, $f_c$. The K-bit input of the accumulator 98 can be thought of as a digital word representative of (e.g., proportional to) the desired frequency of the ultimate DDS output signal, as will be developed hereinafter. In this respect, those skilled in the art will appreciate that this K-bit digital word may conveniently be clocked out of a pre-loaded fixed frequency latch (not shown), or could be clocked out of an EPROM or ROM look-up table (not shown) or a microprocessor (not shown), if variable frequency capability is desired. The accumulator 90 can be thought of as a phase accumulator whose output is a digital phase ramp. As is well-known in the pertinent art, the clock rate ($f_c$) and the accumulator bit length (i.e., the value of K) determine the overflow rate, $f_o$, of the accumulator 98, (i.e., $f_c/K=f_o$) and hence, the output frequency, $f_{DDS}$, of the DDS 82, i.e., the frequency of the DDS output signal $\phi_{DDS,a}$. The output of the accumulator 98 is applied to an adder 100. Although not limiting to the present invention, it is only necessary to, depending upon the phase shift resolution required, apply the N most significant bits (MSB's) of the accumulator output to the adder 100, over lines 102. More particularly, the phase shift resolution of the DDS 82 is given by:

$$\phi_{STEP,a}=360^\circ/2^N, \tag{3}$$

where N is the bit length of the accumulator output $\phi_{total}$.

For a typical accumulator output bit length of N=14 bits, the phase shift resolution of the DDS 82 is given by:

$$\phi_{STEP,a}=360^\circ/2^{14}=0.022^\circ.$$

As can also be seen in FIG. 7, the N-bit digital command signal $S_c$ issued by the microprocessor 94 is also applied to the adder 100, in synchronism with the output/overflow rate, $f_o$, of the accumulator 98. As previously described, the N-bit digital command signal $S_{CA}$ represents the desired phase angle $\phi_a$ value of the output signal $\phi_{DDS,a}$ of the DDS 82. The adder 100 functions in the conventional manner to add the N-bit output, $\phi_{TOTAL}$, of the accumulator 98, and the N-bit digital command signal $S_{CA}$, which can be thought of as a $d\phi$ ($=\phi_a$) signal, to thereby produce an output signal, $\phi_{TOTAL}+d\phi$, representative of the sum of these two input signals ($\phi_{TOTAL}$ and $d\phi$). In this vein, the output, $\phi_{TOTAL}$, of the accumulator 98 constitutes a baseline/-reference digital phase ramp signal, and the digital command signal, $S_{CA}$, constitutes a digital phase shift signal. Since the output, $\phi_{TOTAL}$, of the accumulator 98 constitutes the reference phase condition (i.e., the in-phase condition), it can be appreciated that the output, $\phi_{TOTAL}+d\phi$, of the adder 100 constitutes a phase-shifted version of the digital phase ramp signal output by the accumulator 98, and in fact represents the desired phase angle, $\phi_a$, of the DDS output signal $\phi_{DDS,a}$, since $d\phi=\phi_a$.

The output signal, $\phi_{TOTAL}+d\phi$, of the adder 100 is applied over lines 104 to a digital sine wave generator 106 which functions in the conventional manner to convert the adder output signal, $\phi_{TOTAL}+d\phi$, to a digitized sine wave, sin ($\phi_{TOTAL}+d\phi$), at the DDS output frequency, $f_{DDS}$. As is well-known in the pertinent art, the digital sine wave generator 106 may conveniently be embodied as a ROM device (not shown) or the like. The digitized sine wave, sin ($\phi_{TOTAL}+d\phi$), is applied over line 108 to a digital-to-analog converter 110 which functions in the conventional manner to convert the digitized sine wave, sin ($\phi_{TOTAL}+d\phi$), to an analog sine wave which is filtered by low pass filter 112 and output therefrom over the DDS transmission line 86 to the second input 81 of the mixer 78, as the DDS output signal $\phi_{DDS,a}$. The mixer 78 functions in the conventional manner to directly mix the DDS output signal $\phi_{DDS,a}$ with the incoming RF signal component A. In this vein, the DDS's 82, 84 can be thought of as local oscillators whose LO output signals ($\phi_{DDS,a}$ and $\phi_{DDS,b}$) are heterodyned, by the mixers 78, 80, with the RF signal components (A and B) to produce intermediate frequency (I.F.) output signals ($RF_{A,\,OUT}$ and $RF_{B,\,OUT}$). Further, in the VPSAW device 70 of this invention, the mixer 78 functions to superimpose the phase angle $\phi_a$ of the DDS output signal $\phi_{DSS,a}$ directly onto the incoming RF signal component A, thereby adjusting or shifting its phase by the precise and accurate phase shift step/increment, $\phi_a$. Likewise, the mixer 80 functions to superimpose the phase angle $\phi_b$ of the output signal $\phi_{DDS,b}$ of the DDS 84 directly onto the incoming RF signal component B, thereby adjusting or shifting its phase by the precise and accurate phase shift step/increment,$\phi_b$. Thenceforth, the output signals, $RF_{A,\,OUT}$ and $RF_{B,\,OUT}$, of the mixers 78, 80, are applied over transmission lines 116, 118 to a summer 120 which functions in the conventional manner to sum together or combine the signal $RF_{A,\,OUT}$ and $RF_{B,\,OUT}$, and to output the thusly combined signal, $RF_{OUT}$, over VPSAW device output line 122. Of course, the final output signal $RF_{OUT}$ will have the desired phase, $\phi_c$, and amplitude, C, in accordance with equations (1) and (2) discussed in detail previously.

As will be appreciated by those skilled in the pertinent art, the mixers 78, 80 essentially function as frequency/phase subtractors (adders) such that the frequency, $f_{DDS}$, and the phase shift values, $\phi_a$, $\phi_b$, of the DDS output signals $\phi_{DDS,a}$ and $\phi_{DDS,b}$ are subtracted from (added to) the frequency $f_{IN}$ of the $RF_{IN}$ signal components A and B. Thus, the $RF_{A,\,OUT}$ and $RF_{B,\,OUT}$ signals output by the mixers 78, 80, respectively each have a frequency $f_{IN}-f_{DDS}$, ($f_{IN}+f_{DDS}$) and respective phases $\phi_{OUT,\,a}$ and $\phi_{OUT,\,b}$, equal to the phases ($\phi_{IN,\,a}$;$\phi_{IN,\,b}$) of the $RF_{IN}$ signal components A and B minus (plus) the phase shift steps/increments $\phi_a$, $\phi_b$ of the respective DDS output signals, i.e., $\phi_{OUT,a}=\phi_{IN}-\phi_a$, and $\phi_{OUT,b}=\phi_{IN}-\phi_b$. In this manner, the mixers 78, 80 may be utilized to downconvert (upconvert) the incoming $RF_{IN}$ signal. Accordingly, if the VPSAW device 70 of the present invention were employed in a beam forming network (not shown) of a satellite-based phased array antenna transmitting system (not shown), the $RF_{OUT}$ signal could be made to have the appropriate downlink frequency without the need for a downconverter anywhere in the transmitting system, by merely setting the frequency $f_{DDS}$ of the DDS output signals to the appropriate values. Further, it will be easily and readily appreciated that the VPSAW device 70 of the present invention facilitates extremely accurate and precise phase shifting and amplitude weighting of the $RF_{IN}$ signal over the full 360° range, the exact resolution and accuracy being determined by equation (3) discussed hereinbefore, e.g., 0.022° phase shift resolution. This precision and accuracy is especially important in sophisticated phased array antenna systems having thousands of individual antenna elements. More particularly, this precision and accuracy greatly minimizes undesirable channel-to-channel phase variations over the operating frequency band of the particular system under consideration.

Although the present invention has been described in detail hereinabove, it should be clearly understood that many variations and/or modifications of the basic inventive concepts herein taught which may appear to those skilled in the pertinent art will still fall within the spirit and scope of the present invention, which should be interpreted on the basis of the claims appended hereto. For example, additional benefits (e.g., lower cost, complexity, size, and weight) can be realized by eliminating the ROM 106 and DAC 110 in the DDS's 82, 84. This is possible because the output of the adder 100 provides all of the relevant phase information, and ergo, its MSB or carryout can be utilized to drive the mixer (78 or 80) directly. Elimination of the ROM and DAC would result in substantial DC power savings, particularly if very high-speed GaAs devices are required for a particular application. Further, it should be recognized that the splitter and summer employed in the VPSAW devices constructed in accordance with the present invention have no constraints on their implementation, i.e., they may provide in-phase, out-of-phase, or quadrature phase sums and splits, since the DDS's can be easily programmed with fixed offsets to achieve the correct C,$\phi_c$ values at the output of the VPSAW device. Yet further, although certain details of construction of direct, digital synthesizers have been omitted, these details are well-known in the pertinent art and are readily available in a broad array of prior art references, e.g., in U.S. Pat. Nos. 4,633,183; 4,901,265; 3,984,771; 4,652,832; and, 4,134,076, all of which teachings are herein incorporated by reference.

What is claimed is:

1. A variable phase shifter and amplitude weighting device for selectively varying the phase and amplitude of an input RF signal, $RF_{IN}$, in order to thereby produce an output RF signal, $RF_{OUT}$, having a selected phase and amplitude, the device including:

means for splitting the input RF signal, $RF_{IN}$, into RF signal components A and B;

means for selectively shifting the phase of said RF signal components A and B, to thereby produce selectively phase-shifted signal components A1 and B1;

means for combining said selectively phase-shifted signal components A1 and B1, to thereby produce the output RF signal, $RF_{OUT}$ having a selected phase and amplitude; and wherein:

C represents the selected amplitude, and $\phi_c$ represents the selected phase angle of said $RF_{OUT}$ signal;

$\phi_a$ represents the phase angle of said signal component A:

$\phi_b$ represents the phase angle of said signal component B; and, said selectively phase shifting means is adapted to phase shift said signal components A and B in accordance with the equations $\phi_a=\phi_c+\cos^{-1}(\frac{1}{2}C)$ and $\phi_b=\phi_c-\cos^{-1}(\frac{1}{2}C)$.

2. The device as set forth in claim 1, wherein said selectively phase shifting means includes:

control means for generating first and second phase shift command signals;

a first variable phase shifter responsive to said first phase shift command signal for selectively shifting the phase of said signal component A; and, a second variable phase shifter responsive to said second phase shift command signal for selectively shifting the phase of said signal component B.

3. The device as set forth in claim 2, wherein said control means comprises digital control means responsive to an input signal indicative of the selected phase and amplitude of said $RF_{OUT}$ signal, for generating said first and second phase shift command signals.

4. The device as set forth in claim 3, wherein said first and second phase shift command signals are digital signals.

5. The device as set forth in claim 4, wherein said first variable phase shifter comprises:

first substantially digital means responsive to said first phase shift command signal for generating a first component output signal having said selected first phase angle $\phi_a$;

second substantially digital means responsive to said second phase shift command signal for generating a second component output signal having said selected second phase angle $\phi_b$;

first mixer means for mixing together said signal component A and said first component output signal, to thereby phase shift said signal component A by a first phase shift increment equal to said selected first phase angle $\phi_a$; and, second mixer means for mixing together said signal component B and said second component output signal, to thereby phase shift said signal component B by a second phase shift increment equal to said selected second phase angle $\phi_b$.

6. The device as set forth in claim 5, wherein:

both of said first and second component output signals have a first prescribed frequency $f_1$;

both of said signal components A and B have a second prescribed frequency $f_2$;

said first mixer means is operative to subtract said first prescribed frequency $f_1$ from said second prescribed frequency $f_2$, to thereby downconvert said signal component A to a third prescribed frequency $f_3$ equal to $f_2-f_1$;

said second mixer means is operative to subtract said first prescribed frequency $f_1$ from said second prescribed frequency $f_2$, to thereby downconvert said signal component B to said third prescribed frequency $f_3$; and, whereby said $RF_{OUT}$ signal is downconverted to said third prescribed frequency $f_3$.

7. The device as set forth in claim 5, wherein said first and second substantially digital means each include a direct, digital synthesizer.

8. The device as set forth in claim 5, wherein said first substantially digital means comprises digital synthesizer means, including:

an accumulator for generating an N-bit accumulator output signal representative of a reference digital phase ramp;

an adder for summing together said first phase shift command signal with said accumulator output signal, to thereby produce an N-bit adder digital output signal representative of a selectively phase-shifted version of said accumulator output signal;

a digital sine wave generator for transforming said adder digital output signal into a corresponding digitized sine wave; and, means for converting said digitized sine wave to an analog sine wave, said analog sine wave comprising said first component output signal.

9. The device as set forth in claim 8, wherein:

said first phase shift command signal comprises an N-bit digital signal representative of a first phase shift increment $d\phi_1$ equal to said selected first phase angle $\phi_a$;

$\phi_{TOTAL}$ represents said accumulator output signal;

said adder digital output signal comprises an N-bit digital signal representative of sin $(\phi_{TOTAL}+\phi_a)$; and, said digitized sine wave comprises an N-bit digital signal representative of sin $(\phi_{TOTAL}+\phi_a)$.

10. The device as set forth in claim 9, further including means for filtering said first component output signal upstream of said first mixer means.

11. The device as set forth in claim 1, wherein said digital control means comprises a microprocessor programmed to implement the equations $\phi_a=\phi_c+\cos^{-1}(\frac{1}{2}C)$ and $\phi_b=\phi_c-\cos^{-1}(\frac{1}{2}C)$.

12. The device as set forth in claim 1, wherein said signal components A and B are of equal amplitude.

13. A variable phase shifter and amplitude weighting device for selectively varying the phase and amplitude of an input RF signal in order to produce an RF output signal having a selected phase, $\phi_c$, and amplitude, C, the device including:

means for dividing said input RF signal into separate first and second RF signal components;

means for generating a first control signal indicative of a first phase shift increment $\phi_a$, and a second control signal indicative of a second phase shift increment $\phi_b$;

means responsive to said first and second control signals for phase shifting said first RF signal component by said first phase shift increment $\phi_a$, and for phase shifting said second RF signal component by said second phase shift increment $\phi_b$, to thereby produce first and second phase-shifted RF signal components, respectively, said phase shifting means comprising:

first digital synthesizer means for generating a first sinusoidal output signal;

second digital synthesizer means for generating a second sinusoidal output signal;

first mixer means for mixing together said first RF signal component and said first sinusoidal signal, to thereby phase shift said first RF signal component by said first phase shift increment, $\phi_a$; and and, second mixer means for mixing together said second RF signal component and said second sinusoidal signal, to thereby phase shift said second RF signal component by said second phase shift increment, $\phi_b$;

means for combining said first and second phase-shifted RF signal components, to thereby produce said output RF signal; and, wherein said first and second phase shift increments, and respectively, satisfy a prescribed algorithm which results in said output RF signal having said selected phase, $\phi_c$, and amplitude, C.

14. The device as set forth in claim 13, wherein said prescribed algorithm is digitally implemented by control means for generating said first and second control signals.

15. The device as set forth in claim 14 wherein:

said prescribed algorithm includes first and second sub-algorithms;

said first sub-algorithm is $\phi_a=\phi_c+\cos^{-1}(\frac{1}{2}C)$;

said second sub-algorithm is $\phi_b=\phi_c-\cos^{-1}(\frac{1}{2}C)$;

said first control signal is a digital representation of $\phi_a$; and, said second control signal is a digital representation of $\phi_b$.

* * * * *